US005123185A

United States Patent [19]

Pollard

[11] Patent Number: 5,123,185

[45] Date of Patent: Jun. 23, 1992

[54] FRONT LOADER JAW ACCESSORY

[76] Inventor: Albert C. Pollard, P.O. Box 266, Irvington, Va. 22480-0266

[21] Appl. No.: 725,592

[22] Filed: Jul. 3, 1991

[51] Int. Cl.[5] ..... E02F 3/96

[52] U.S. Cl. ..... 37/117.5; 37/DIG. 12; 37/118 A; 414/912

[58] Field of Search ..... 37/117.5, DIG. 3, DIG. 12, 37/118 A; 414/607, 724, 912

[56] References Cited

U.S. PATENT DOCUMENTS

| | | | |
|---|---|---|---|
| 2,387,656 | 10/1945 | Gledhill | 37/117.5 |
| 2,799,412 | 7/1957 | Pilch | 414/704 |
| 3,296,720 | 1/1967 | Sageser | 37/117.5 |
| 3,344,540 | 10/1967 | Ulrich | 37/117.5 |
| 3,598,266 | 10/1971 | Fisher | 414/704 |
| 4,030,626 | 6/1977 | Durham | 37/118 A X |
| 4,285,628 | 8/1981 | Jankowski | 414/912 X |
| 4,403,906 | 9/1983 | Holopanen | 414/724 |

FOREIGN PATENT DOCUMENTS

| | | | |
|---|---|---|---|
| 661115 | 3/1965 | Belgium | 37/118 A |

*Primary Examiner*—Randolph A. Reese
*Assistant Examiner*—Arlen L. Olsen
*Attorney, Agent, or Firm*—Sughrue, Mion, Zinn, Macpeak & Seas

[57] ABSTRACT

A jaw (18) for a tractor front loader which is activated by the existing bucket cylinder (15) found on front loaders.

The jaw (18) and associated parts may utilize as points of attachment the pivots at both ends of the bucket cylinder (15) found on existing loaders. The jaw (18) closes against the bucket (13) to facilitate grasping bulky objects.

6 Claims, 2 Drawing Sheets

FRONT LOADER JAW ACCESSORY

BACKGROUND

1. Field of Invention

This invention relates to front loaders as used on construction and farm tractors, specifically to an upper jaw mounted above the loader bucket to facilitate handling of bulky materials.

2. Description of Prior Art

Front loaders with a jaw to facilitate handling of cumbersome objects such as tree stumps, broken concrete and similar materials are not new. Heretofore front loaders equipped with the jaw have been expensive, because of the additional hydraulic equipment necessary to operate them. In addition to being expensive, the jaw could not later be added to loaders that were not initially equipped with them without expensive replacement or modification of parts of the loader.

OBJECT AND ADVANTAGES

The object of this invention is to provide a jaw for a front loader bucket which is inexpensive and can be added to an existing loader without modificaiton to the loader. My invention reduces the cost of the jaw by eliminating the necessity of the hydraulic cylinder and associated equipment. Furthermore, the jaw may be added to existing loaders without modification to the loader because it can utilize as points of attachment pivot points found on all conventional front loaders.

Further objects and advantages of my invention will become apparent from a consideration of the drawings and ensuing description of it.

Installation of the jaw accessory of my invention may be as simple as removing existing pivot pins and replacing them with longer pins to attach the jaw accessory to the front loader.

No longer is it required for the purchaser of a front loader to decide if he wants the option of having jaws on the loader at the time of purchase, because the jaws can later be purchased at low cost and installed in a few minutes without the use of special tools.

DRAWING FIGURES

Description of Invention

Figure 1:
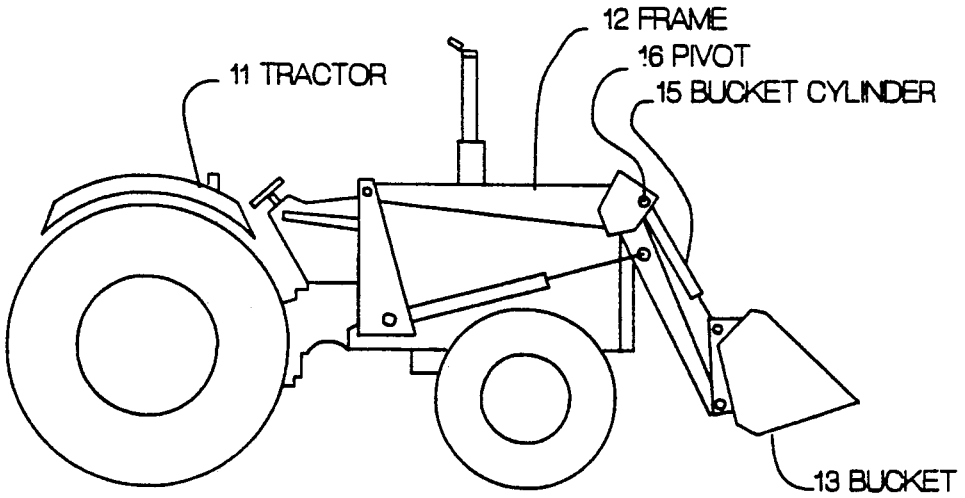
FIG. 1 shows a tractor (11) with a typical front loader bucket (13).

Whereas, a key object of the invention is that the jaws of this invention may be added to existing equipment without modification of the existing equipment, an understanding of the structure of a typical existing front loader is necessary. FIG. 1 shows a tractor (11) with a typical front loader bucket (13). The figure is a profile drawing and thus does not show depth which would correspond to the width of the tractor (11). Typically the bucket (13) is roughly the width of the tractor (11). Attachment of the bucket (13) to the tractor (11) is by means of a set of similar components on each side the tractor (11). These components consist of the frame (12), half of which is illustrated on the near side of the tractor (11). Except as noted, each of the following parts are paired with a similar part on the opposite side of the tractor (11). The frame (12) is shown in the same position in all of the Figures. Although the frame movements are an essential part of the loader operation, its movement does not directly effect this invention and thus is not a subject of discussion. The bucket (13) which is approximately the width of the tractor (11) is attached to each half of the frame (12) at the bucket pivot (14). Rotation of the bucket (13) around the bucket pivot (14) is activated by the bucket cylinder (15), which connects to the bucket (13) at the cylinder to bucket pivot (17). The upper end of the bucket cylinder (15) is connected to the frame at the cylinder to frame pivot (16).

Figure 2:
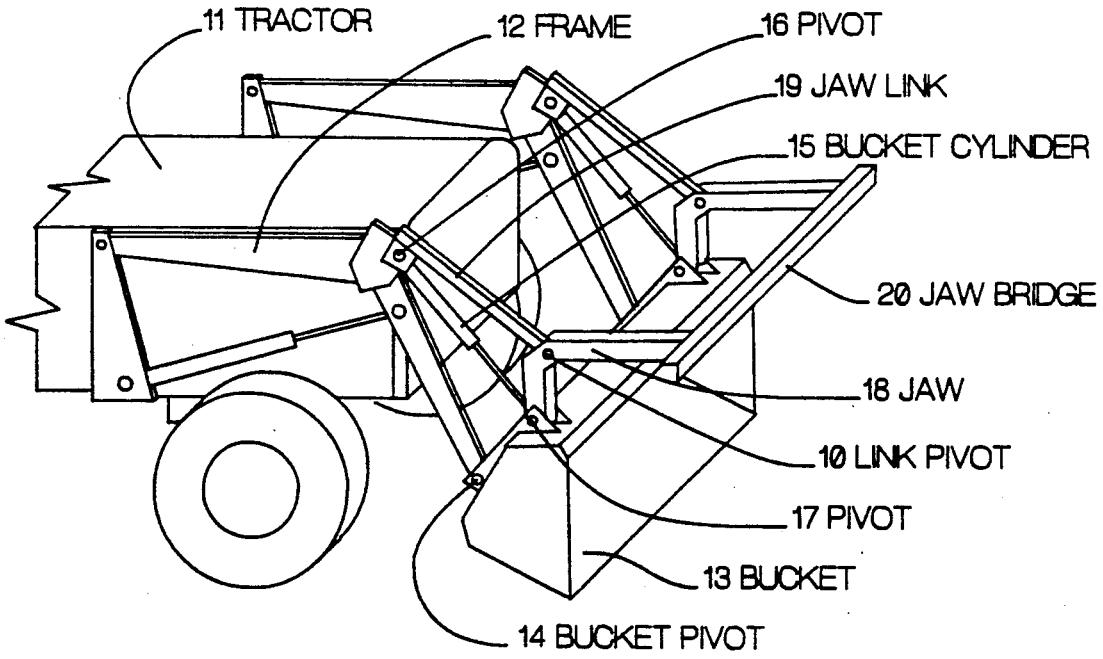
FIG. 2 is a perspective drawing of my invention with the jaw open.

FIG. 2 shows the jaw installed. The jaw arm (18) and its jaw link (19) is also made up of a pair of similar components connected to each half of the frame (12) at the cylinder to frame pivot (16) and to the bucket (13) at the cylinder to bucket pivot (17). Jaw link (19) may be adjustable in length.

Jaw bridge (20) connects the jaw arm (18) of each side of the tractor (11).

Figure 3:
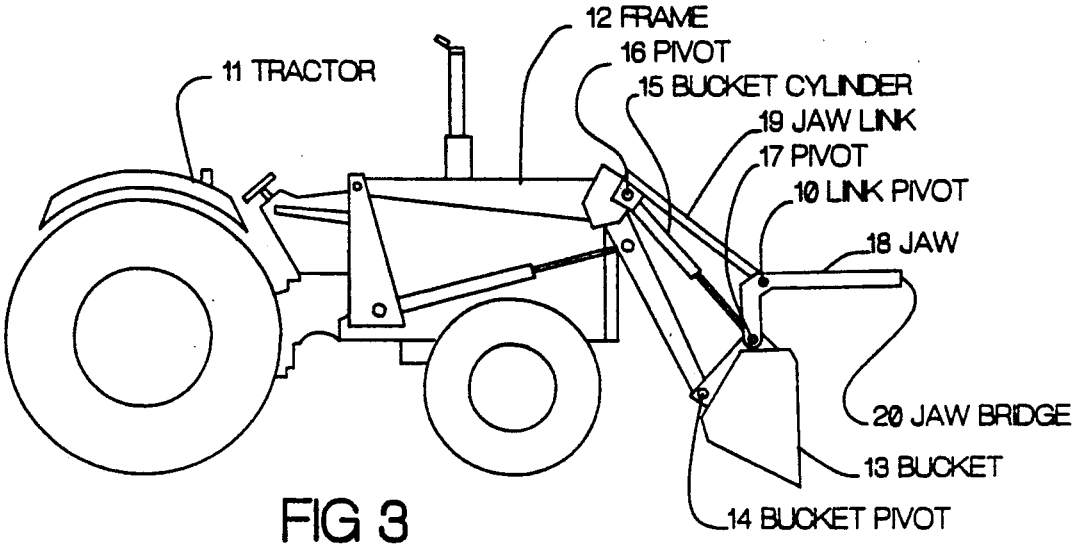
FIG. 3 is a profile of FIG. 2.

FIG. 3 shows all of the components of FIG. 2 in profile.

Figure 4:
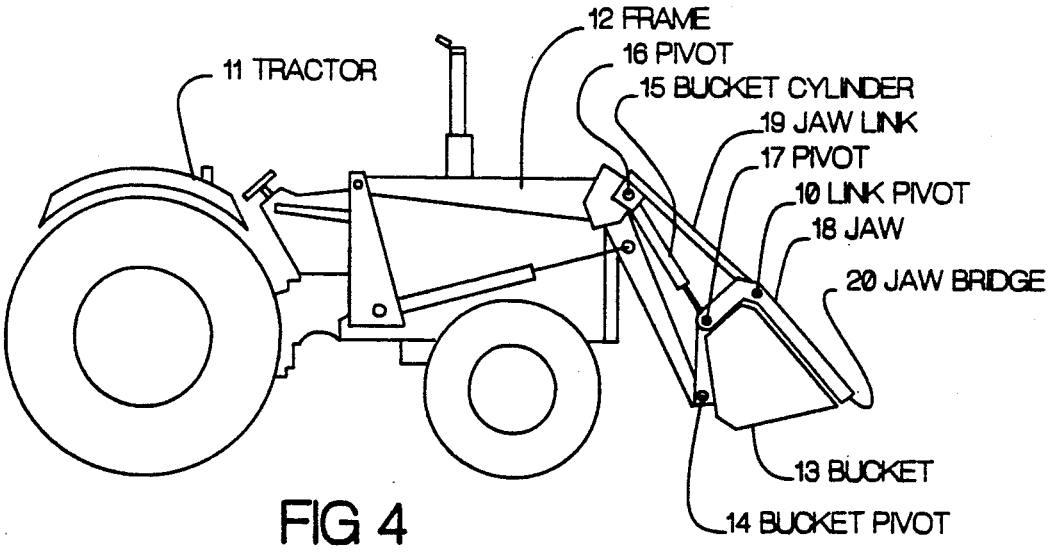
FIG. 4 is a profile of my invention with the jaw closed.

FIG. 4 shows all of the components of FIG. 2 and FIG. 3 in a different relative position.

In summary, the jaw arm (18) and jaw link (19) are attached by means of the cylinder to frame pivot (16) and the cylinder to bucket pivot (17) which are standard parts of a typical loader.

OPERATION OF INVENTION

FIGS. 2 and 3 illustrate the front loader bucket (13) in a partially lowered position. The action of rolling back or moving the bucket in a counter clockwise direction is by means of the retraction of the bucket cylinder (15). Retraction of the bucket cylinder (15) simultaneously causes counter clockwise rotation of the bucket (13) and clockwise rotation of the jaw arm (18) about the cylinder to bucket pivot (17). The opposite rotation of the bucket (13) and the jaw arm (18) result in the jaw arm (18) closing against the bucket (13) as illustrated in FIG. 4.

Stated a different way, when the operator wishes to grasp an object between the jaw bridge (20) and the bucket (13) he causes the bucket cylinder (15) to retract. This action causes the angle between the bucket (13) and the jaw arm (18) to be reduced thus moving the jaw bridge (20) toward the bucket (13) simultaneously with the movement of the outer edge of the bucket (13) towards the jaw bridge (20).

The above description is of the preferred embodiment of my invention and being the preferred embodiment, the cylinder to frame pivot (16) and the cylinder to bucket pivot (17) were used as the points of attachment for the jaw link (19) and the jaw arm (18) respectively. Although these attachment points are shown in my preferred embodiment, different points of attachment could be used on the frame (12) and the bucket (13) provided that these different points of attachment maintain the same general relative positions so that the invention operates as described.

Note in FIG. 4 of the preferred embodiment that the length of the jaw link (19) is such that the jaw bridge (20) is closed against the bucket (13) when the bucket is in its full rolled back position. There may be circumstances when it is desirable for the jaw (18) to be open somewhat when the bucket is in the full rolled back position. To accommodate these circumstances the jaw link (19) may have a means to adjust its length.

Note also that the preferred embodiment utilizes a jaw (18) which has its structural element over the top of the bucket (13). I selected this configuration for illustration because with this configuration forces are in two vertical planes, one on each side of the tractor. Each of these planes contains a frame member (12), a bucket cylinder (15), a jaw arm (18) and a jaw link (19). Jaws could be mounted at other locations such as at the ends of the bucket (13). Jaws mounted at other locations would have pivots at the same general profile positions as illustrated in FIG. 3 and 4.

CONCLUSION, RAMIFICATIONS, AND SCOPE OF INVENTION

The reader can see that my invention provides an inexpensive means of adding the utility of jaws onto existing loaders, without having to replace expensive parts on the loader. Although my descriptions have shown one embodiment of the invention, the scope of the invention should be determined by the appended claims and their legal equivalents. Furthermore, the use of the invention is not limited to the handling of bulky material as described above. For example, the jaw assembly would serve to retain materials such as concrete or loose sand in the bucket.

I claim:

1. An accessory for use on a tractor equipped with a front loader, having a unitary frame (12) having a pivotal connection on said tractor, a bucket (13) having a pivotal connection on said frame, one or more bucket cylinders (15), each with a first end having a pivotal connection on said frame and a second end having a pivotal connection on said bucket; said accessory comprising:

(a) one or more jaw arms (18) having a pivotal connection on said bucket (13), (b) each of said jaw arms (18) having a jaw link (19).

(c) a first end of each said jaw link (19) having a pivotal connection on said jaw arm (18), and (d) a second end of each said jaw link (19) having a pivotal connection on said frame (12), wherein actuation of the bucket cylinder is solely responsible for rotation of the jaw arm (18) relative to the bucket (13).

2. The loader accessory of claim 1 wherein said second end of each said bucket cylinder and a respective one of said jaw arms have pivotal connections on said bucket on the same pivot axis.

3. The loader accessory of claim 1 wherein said first end of each bucket cylinder and said second end of a respective jaw link have pivotal connections on said frame on the same pivot axis.

4. The loader accessory of claim 1 wherein the jaw arms (18) are two in quantity, and are mounted generally above said bucket (13).

5. The loader accessory of claim 1 wherein the jaw arms (18) are two in quantity, are mounted generally above said bucket, and each of said jaw arms (18) is in a vertical plane with one of said bucket cylinders (15), and one of said jaw links (19), whereby mechanical forces in the jaw arm, the bucket cylinder, and the jaw link are coplanar.

6. An accessory for use on a tractor equipped with a front loader, having a unitary frame (12) having a pivotal connection on said tractor, a bucket (13) having a pivotal connection on said frame, two bucket cylinders (15), each with a first end having a pivotal connection on said frame and a second end having a pivotal connection on said bucket; said accessory comprising:

(a) two jaw arms (18) each having a pivotal connection on said bucket (13), (b) each of said jaw arms (18) having a jaw link (19), (c) a first end of each said jaw link (19) having a pivotal connection on said jaw arm (18), and (d) a second end of each said jaw link (19) having a pivotal connection on said frame (12), wherein actuation of the bucket cylinder is soley responsible for rotation of the jaw arm (18) relative to the bucket (13).

* * * * *